US005960699A

United States Patent [19]

Alaze

[11] Patent Number: 5,960,699

[45] Date of Patent: Oct. 5, 1999

[54] HYDRAULIC PUMP UNIT

[75] Inventor: Norbert Alaze, Markgroeningen, Germany

[73] Assignee: Robert Bosch GmbH, Stuttgart, Germany

[21] Appl. No.: 08/931,508

[22] Filed: Sep. 16, 1997

[30] Foreign Application Priority Data

Sep. 16, 1996 [DE] Germany ..... 196 37 646

[51] Int. Cl.[6] ..... F16J 1/10

[52] U.S. Cl. ..... 92/129; 92/72; 92/138

[58] Field of Search ..... 92/138, 129, 12.1, 92/72

[56] References Cited

U.S. PATENT DOCUMENTS 1,925,610 9/1953 Shinn ..... 92/138
5,100,305 3/1992 Zirps ..... 92/129

FOREIGN PATENT DOCUMENTS 0 699 836 A2 3/1996 European Pat. Off. .
42 41 837 A1 6/1995 Germany .

*Primary Examiner*—Thomas E. Denion
*Attorney, Agent, or Firm*—Edwin E. Greigg; Ronald E. Greigg

[57] ABSTRACT

The invention relates to a hydraulic pump unit with an electric drive motor and a radial piston pump that is provided as a return feed pump for a motor vehicle for a slip-regulated, hydraulic brake system. To drive the pump pistons, the invention provides a rod-shaped eccentric element that is supported eccentrically with ball heads in a shaft end of a drive shaft of the drive motor and disposed on an opposite side of the pump pistons in a pump housing is supported so that the eccentric element can swivel around a solid angle. When the drive shaft is rotated, the eccentric element executes a movement on a surface of a cone so that the pump pistons resting against the eccentric element are driven in a reciprocating stroke motion. The invention has the advantage of a mechanically defined bearing support of the drive shaft and eccentric element so that the bearing of the eccentric element, which bearing is fixed to the housing, does not have to be exactly flush with the drive shaft.

7 Claims, 2 Drawing Sheets

HYDRAULIC PUMP UNIT

BACKGROUND OF THE INVENTION

The invention is based on a hydraulic pump unit for a slip controlled hydraulic brake system for a motor vehicle.

The hydraulic pump unit is provided as a return feed pump for a motor vehicle for a slip-controlled hydraulic brake system. A hydraulic pump unit of this kind has been disclosed by EP 0 699 836 A2. The known hydraulic pump unit has an electric drive motor with a drive shaft whose one shaft end has an eccentric pin that is of one piece with it and is for driving a piston pump whose pistons are disposed radial to the drive shaft. The drive shaft is supported at three points, namely on both sides of an armature of the electric motor and at an end of the eccentric pin remote from the motor. The piston pump is embodied as a radial piston pump having one or a number of pistons disposed in a star pattern radial to the drive shaft; the end faces of these pistons rest against the eccentric pin and are thus driven to a reciprocating stroke motion with the rotation of the drive shaft.

The so-called three point support of the drive shaft has the disadvantage that it is not statically defined, i.e. the three bearings must be exactly in alignment in order to permit a low friction rotation of the drive shaft without its being elastically flexed with every rotation. The drive shaft with its three bearing seats must therefore be manufactured with a high degree of precision. Furthermore, three bearing seats in a motor housing and a pump housing must be manufactured very precisely and must be aligned exactly flush with one another when assembling the motor housing and the pump housing; the manufacturing and assembly costs of the known hydraulic pump unit are therefore high.

Moreover, the eccentric pin must be manufactured of one piece with the drive shaft, which further increases the manufacturing cost of the drive shaft. To reduce the friction between the pump piston and the eccentric pin, a roller bearing is provided on the eccentric pin. For a sufficiently smooth surface for the rolling of the bearing rollers, the eccentric pin must be ground, which additionally increases the manufacturing cost.

OBJECT AND SUMMARY OF THE INVENTION

The hydraulic pump unit according to the invention has an eccentric element which is eccentrically supported on a shaft end of the drive shaft oriented toward the radial piston pump so that it can swivel around a solid angle and is also supported in a stationary fashion in a pump housing on an end of the pump piston remote from the drive motor so that it can swivel around a solid angle. When the drive shaft rotates, the end of the eccentric element supported on the drive shaft moves in a circular path, the eccentric element moves on the surface of a cone that has a cone point in the center point of the swivel bearing in the pump housing, on the end remote from the drive motor. In a central region between the swivel bearing pumps, the pump piston(s) rest with their end faces against the eccentric element and are driven in a reciprocating stroke motion.

The invention has the advantage that the drive shaft of the drive motor is only supported at two points on opposite sides of the armature, i.e. it is contained in the motor housing in a statically defined manner. This requires less precision for its manufacture. A further advantage is that the drive shaft is only supported in the motor housing, which is why the pump housing does not have to be mounted exactly flush on the motor housing. The production expenditure is thus reduced considerably. Moreover, the eccentric element is manufactured as a separate part and does not have to be manufactured eccentrically as one piece with the drive shaft. Friction and wear are reduced as well as the noise generation due to the statically defined support of the drive shaft and the eccentric element. It is a further advantage that the drive shaft is not put under bending stress by the pump piston, which is to be driven radial to it.

Advantageous improvements and updates of the invention disclosed are the subject of the invention.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
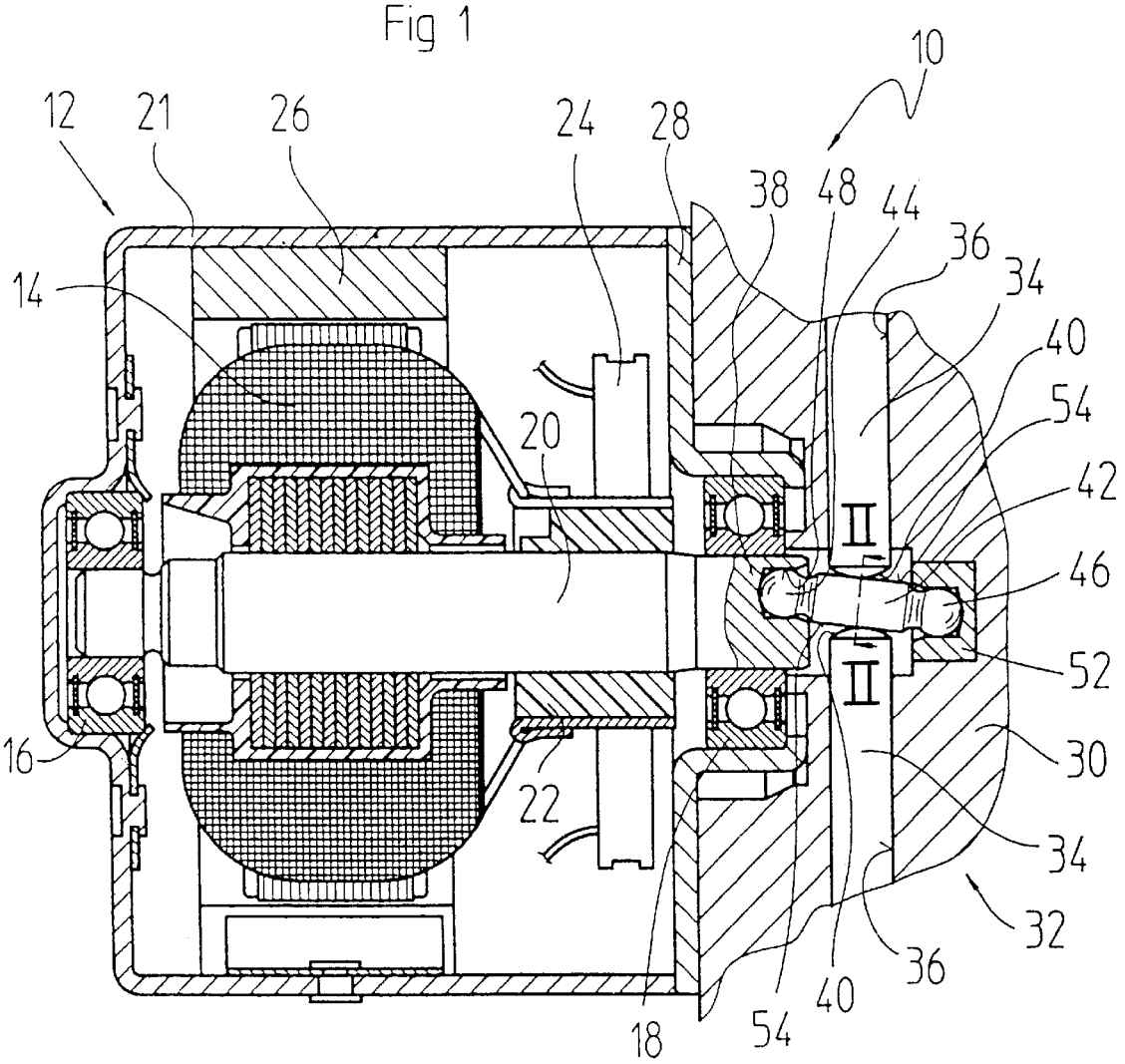
FIG. 1 shows an axial section through a hydraulic pump unit according to the invention.

The hydraulic pump unit 10 according to the invention shown in the drawings has an electric drive motor 12 with a drive shaft 20, which is supported so that it can rotate in ball bearings 16, 18 on opposite sides of an armature 14 and is inserted into a motor housing 21. The power supply to an armature winding is carried out in a manner that is known per se, by means of a collector 22 mounted non-rotatably on the drive shaft 20 and carbon brushes 24 secured in the motor housing 21. Permanent magnets 26 of a stator are fixed in the motor housing 21.

A pump housing 30 of a radial piston pump 32 is screwed to an end wall 28 of the motor housing 21. Two pump pistons 34 are supported so that they can move in cylinder bores 36 in the pump housing 30. The pump pistons 34 are coaxial to each other and are disposed radially to a rotational axis of the drive shaft 20 outside its shaft end 38.

With end faces 40 oriented toward each other, the pump pistons 34 rest against a short, rod-shaped eccentric element 42 disposed between them. The two ends of the eccentric element 42 are embodied as ball heads 44, 46 and are supported on opposite sides of the pump pistons 34 so that they can swivel around a solid angle, i.e. on a cone. The one ball head 44 is supported so that it can swivel in a blind cylinder bore 48, which, in an eccentric and axially parallel manner, is let into the shaft end 38 of the drive shaft 20 oriented toward the radial piston pump 32. This ball head 44 thus moves in a circular path when the drive shaft 20 is driven to rotate.

The other ball head 46 on the other end of the eccentric element 42 is supported in a bearing shell 52 so that it can swivel around a solid angle; the bearing shell is inserted into the pump housing 30 on an end of the pump pistons 34 disposed opposite the drive shaft 20. When the drive shaft 20 is rotated, the eccentric element 42 therefore moves on a surface of a cone, whose point is disposed in the center point of the ball head 46 which is supported so that it can swivel in the pump housing 30 and whose opening angle is a function of the eccentricity of the blind cylinder bore 48 in the drive shaft 20 as well as the spacing of the two ball heads 44, 46 from each other. As a result of this motion of the eccentric element 42 on a surface of a cone, the pump pistons 34 resting against it are driven in a reciprocating stroke motion. The pump pistons 34 can be held in contact with the eccentric element 42, for example, in a manner that is known per se, by means of helical compression springs, not shown, which engage end faces of the pump pistons 34 remote from the eccentric element 42.

Figure 2:
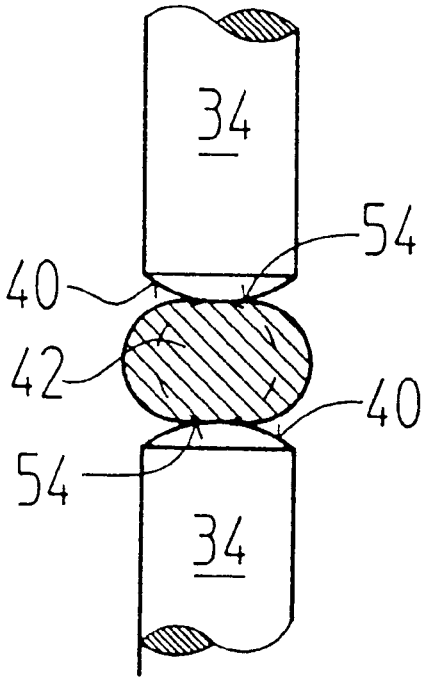
FIG. 2 shows an enlarged section along line II—II in FIG. 1.
Figure 3:
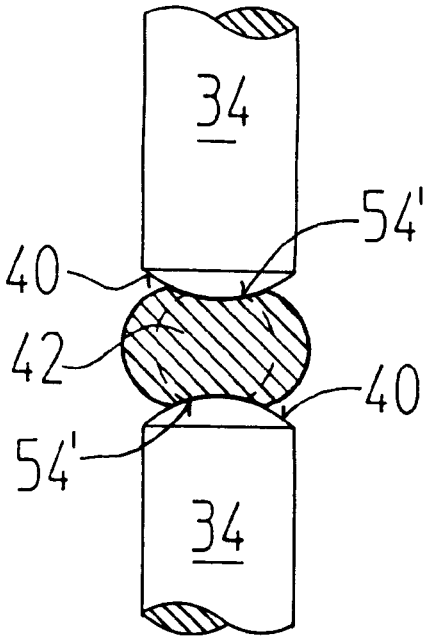
FIG. 3 is an enlarged partial sectional view similar to FIG. 2 illustrating an eccentric element with arched recesses.

In order to improve the contact of the end faces 40 of the pump pistons 34 against the eccentric element 42, the end faces 40 are embodied as ball-shaped surfaces. In order to enlarge the contact area and therefore to reduce surface pressure and wear, the eccentric element 42 has an oval cross section (FIG. 2), that is, its contact faces 54 oriented toward the pump pistons 34 are flattened. To further enlarge the contact faces 54, they can also be embodied as arched recesses 54' on the eccentric element 42 as shown in FIG. 3.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A hydraulic pump unit for a slip-controlled motor vehicle brake system, comprising a drive motor that has a drive shaft, a piston pump that is disposed on one shaft end of the drive shaft and has at least one pump piston disposed approximately radially with regard to the drive shaft, an eccentric element (42) for driving the at least one pump piston (34), said eccentric element is eccentrically supported on a shaft end (38) of the drive shaft (20) oriented toward a radial piston pump (32) and, spaced apart from an extension of the drive shaft (20), said eccentric element is supported in a stationary fashion with regard to the drive motor (12) and the piston pump (32) so that said eccentric element swivels around a solid angle, wherein the at least one pump piston (34) rests with an end face (40) against the eccentric element (42) in a central region between two bearing positions (38, 52).

2. A hydraulic pump unit according to claim 1, in which the eccentric element (42) has a ball head (44, 46) on opposite ends for supporting said eccentric element so said eccentric element can swivel around the solid angle.

3. The hydraulic pump unit according to claim 1, in which the end face (40) of the pump piston (34) that rests against the eccentric element (42) is ball-shaped and that the eccentric element (42) has a contact face (54) for the at least one pump piston (34), which face is one of flattened and an arched recess.

4. The hydraulic pump unit according to claim 2, in which the end face (40) of the pump piston (34) that rests against the eccentric element (42) is ball-shaped and that the eccentric element (42) has a contact face (54) for the at least one pump piston (34), which face is one of flattened and an arched recess.

5. A hydraulic pump unit as set forth in claim 1, which includes oppositely disposed pump pistons (34).

6. A hydraulic pump unit as set forth in claim 2, which includes oppositely disposed pump pistons (34).

7. A hydraulic pump unit as set forth in claim 3, which includes oppositely disposed pump pistons (34).

* * * * *